US005281148A

United States Patent [19]

Thompson

[11] Patent Number: 5,281,148

[45] Date of Patent: Jan. 25, 1994

[54] ELECTRICAL CIRCUIT CARD CONNECTOR

[75] Inventor: John R. Thompson, LaQuinta, Calif.

[73] Assignee: Trakker, Inc., Tulsa, Okla.

[21] Appl. No.: 945,263

[22] Filed: Sep. 15, 1992

[51] Int. Cl.[5] ..... H01R 9/09; H01R 23/72

[52] U.S. Cl. ..... 439/59; 439/17; 439/86; 439/630

[58] Field of Search ..... 439/65, 66, 69, 74, 439/86, 91, 17, 59, 630

[56] References Cited

U.S. PATENT DOCUMENTS

| | | | |
|---|---|---|---|
| 4,882,657 | 11/1989 | Braun | 439/91 |
| 4,931,622 | 6/1990 | Ohtsuki et al. | 439/629 X |
| 4,993,957 | 2/1991 | Shino | 439/86 |

FOREIGN PATENT DOCUMENTS

| | | | |
|---|---|---|---|
| 2619474 | 2/1989 | France | 439/17 |

*Primary Examiner*—Timothy V. Eley
*Assistant Examiner*—Khan V. Nguyen
*Attorney, Agent, or Firm*—Head & Johnson

[57] ABSTRACT

A connector for interfacing a circuit resident on a printed circuit board having rows of externally accessible contact pads on a face of the board with a circuit resident on a portable card having rows of externally accessible contact pads on a face of the card has independently biased ball bearing contacts which assure positive, self-cleaning, self-sealing, self-adjusting electrical contact between the circuits.

A flat base has rows of apertures therethrough spaced for alignment with the pads of the board when the base is laminarly juxtaposed on the face of the board. Sinks connect the apertures in rows and the conductive ball bearings are retained in each of the apertures by annular shoulders on the apertures. Strips of elastomer formed of layers of conductive and dielectric materials are snugly seated in each sink with the layers transverse to the rows. The strips bias the ball bearings against the shoulders when the base is laminarly juxtaposed on the face of the board. Feet and bosses on the connector engage with sockets and dimples on the board to rigidly connect the base to the board with the strips in abutment with the rows of pads on the board.

A housing fixed to the base receives, aligns and holds the card in laminar juxtaposition against the ball bearings so that discrete conductive paths are defined by aligned card pads, ball bearings, elastomer layers and board pads.

20 Claims, 2 Drawing Sheets

ELECTRICAL CIRCUIT CARD CONNECTOR

BACKGROUND OF THE INVENTION

This invention relates generally to electrical interface devices and more particularly concerns connectors for interfacing circuit boards with portable circuit cards.

Presently known electronic card connectors are generally soldered to the circuit board circuitry with which they are to be associated. These connections are intended to be permanent and, when damaged, require time consuming and expensive repair or replacement. Usually a switch at the card connector edge is triggered by the insertion of the card and any card will activate the system, even if inserted upside down. Their circuits are generally disconnected from the board circuit by use of a separate switch external to the connector. Their contacts are generally arranged in a way that variations or irregularities in the card surface can inhibit positive electrical contact or cause physical damage to the card. They are generally composed of many separate parts, increasing the cost of both manufacture and assembly. And they are susceptible to infiltration by dust, dirt and other undesirable substances which can cause failure in the mechanical and electrical operation of the system.

It is, therefore, among the objects of this invention to provide a card connector that may be readily snapped on or off a circuit board. Another object of this invention is to provide a card connector having an internal switch activated only by proper insertion of a proper card into the connector. It is also an object of this invention to provide a card connector which compensates for variations in the surface or thickness of the card as well as variations in the dimensions of the connector components, be they the result of structural tolerances or temperature related compression-expansion characteristics, to assume positive electrical connection between the card and the connector. Correlatively, it is an object of this invention to provide a card connector in which discrete circuits are completed by independently free moving conductive ball bearings. And, it is an object of this invention to provide a card connector having a small number of components and an integrally molded body. Another object of this invention is to provide a card conductor which minimizes the possibility of damage to a card inserted therein. It is a further object of this invention to provide a card connector that is self-sealing against intrusion of foreign substances in the absence of a card in the connector. Still another object of this invention is to provide a card connector having contacts which are wiped during use to enhance the possibility of repetitively positive electrical connections.

SUMMARY OF THE INVENTION

In accordance with the invention, a circuit card connector is provided for interfacing a circuit resident on a printed circuit board having rows of externally accessible contact pads on its face with a circuit resident on a portable card having rows of externally accessible contact pads on its face. The connector has a card receiving housing with a flat base and a flat cover spaced by side walls to define a flat, externally accessible passage for guiding and holding the card in a laminar position between the base and the cover. Apertures in the base are spaced for alignment with the pads of the board when the base is laminarly juxtaposed on the face of the board and each of the apertures has a tapered shoulder along its outer end retaining a conductive ball bearing in each aperture. Strips of elastomer formed from layers of conductive and dielectric material are snugly seated in sinks connecting the apertures in rows with the layers transverse to the rows. The strips bias the ball bearings independently against the shoulders so that the ball bearings penetrate into the passage when the base is laminarly juxtaposed on the face of the board.

Clips and bosses on the base cooperate with sockets and dimples in the board to rigidly connect the base to the board with the strips in abutment with the rows of pads on the board. Thus, when the card is inserted into the passage, discrete conductive paths are defined by aligned card pads, ball bearings, elastomer layers and board pads.

The connector preferably has ribs integrally inwardly projecting into each of the sinks to grip the strips of elastomer. Furthermore, the sinks have a depth greater than the depth to the ball bearings when the ball bearings are seated against their shoulders so that the strips are compressed between the ball bearings and the board when the base is in abutment with the board. Preferably, the apertures have bevelled edges into which the strips can partially expand when they are compressed between the ball bearings and the board.

The connector passage also preferably has a bevelled mouth for slidably receiving the card with minimal possibility of physical damage. Additionally, the connector base may have a land protruding toward the ball bearings for holding the card in firm slidable engagement with the ball bearings. The land also results in a deeper passage on either side of the land, thus further minimizing the possibility of physical change to the card.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
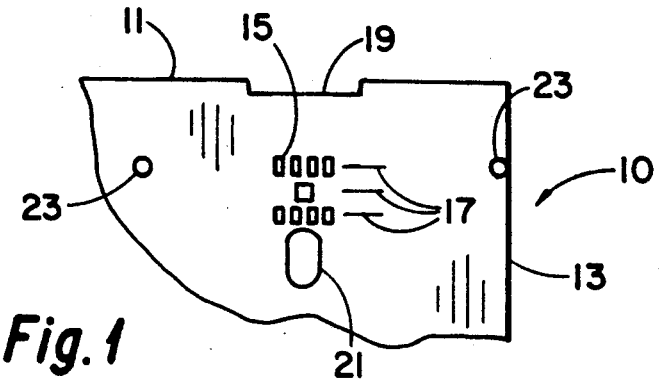
FIG. 1 is a partial top plan view illustrating a portion of a circuit board adapted for use with the circuit card connector.
Figure 5:
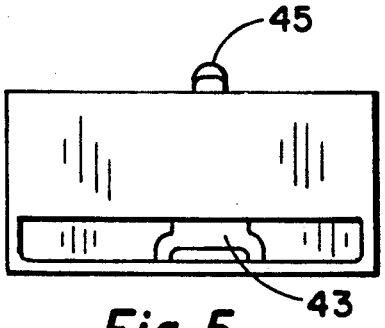
FIG. 5 is a top plan view of the circuit card connector of FIG. 2.
Figure 3:
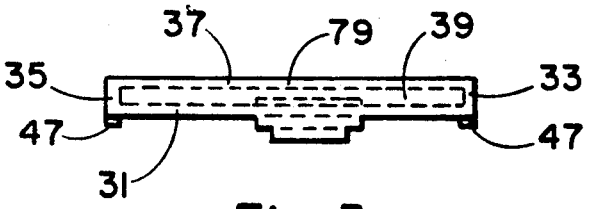
FIG. 3 is a side elevation view of the circuit card connector of FIG. 2.

Turning first to FIG. 1, a corner of a typical circuit board 10 having edges 11 and 13 is illustrated. The board 10 includes a plurality of electrically conductive contact pads 15 arranged in rows 17 externally accessible on the surface of the card 10 and discretely connected to the circuit resident on the printed circuit board 10. As shown, for use with the present invention, this typical circuit board 10 has been modified by the addition of a notch 19 in one of its edges 11 and a socket 21 through the circuit board spaced some distance from the notch 19. A plurality of sockets 21 could be used instead. The circuit board 10 is also provided with two or more dimples or holes 23 spaced apart in the surface of the circuit board 10.

A preferred embodiment of the card connector 30 is illustrated in FIGS. 2 through 5. The connector 30 has a substantially flat base member 31 spaced by side walls 33 and 35 from a substantially flat cover member 37 to form a housing about a flat, narrow passage 39 into which the card (not shown) can be slidably inserted in laminar disposition between the base member 31 and the cover member 37.

Figure 4:
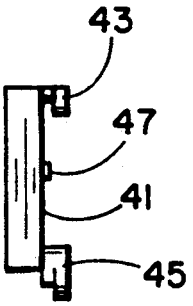
FIG. 4 is an end elevation view of the circuit card connector of FIG. 2.
Figure 2:
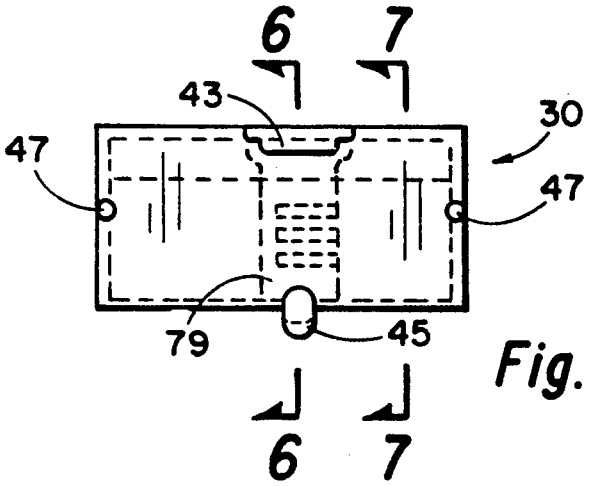
FIG. 2 is a bottom plan view of a preferred embodiment of the circuit card connector.

As can best be seen in FIG. 4, an outer face 41 of the base member 31 has feet 43 and 45 depending therefrom, the positioning of the feet 43 and 45 being coordinated to the positioning of the notch 19 and socket 21 in the circuit board 10 so that the feet 43 and 45 can be inserted into the notch 15 and socket 21 with the outer face 41 of the base member 31 laminarly juxtaposed to the face of the circuit board 10. In this position, the connector 30 may be slid on the surface of the circuit board 10 to couple the connector 30 to the board 10. The outer face 41 of the base member 31 may also be provided with bosses 47 located to engage with the dimples or holes 23 in the circuit board 10 and lock the connector 30 in its appropriate position on the circuit board 10.

Figure 6:
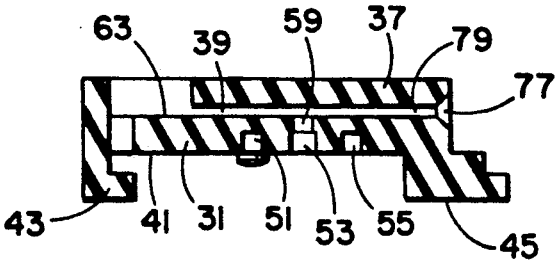
FIG. 6 is a cross-sectional view taken along the line 6—6 of FIG. 2.
Figure 8:
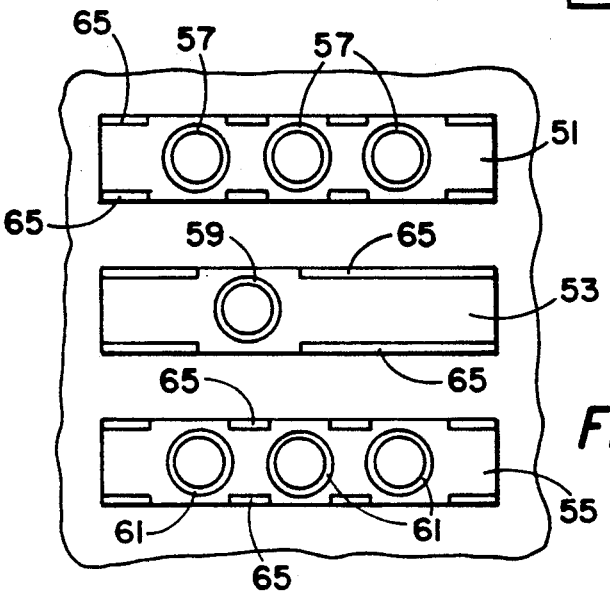
FIG. 8 is an enlarged bottom plan view of the hole pattern of the circuit card connector of FIG. 2.
Figure 9:
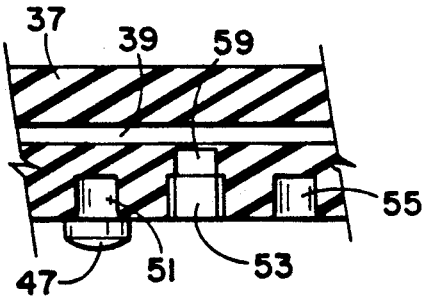
FIG. 9 is a partial enlarged view of the hole pattern illustrated in FIGS. 6 and 8.

Turning to FIG. 6, a portion of the housing through which discrete electrical paths are likely to be connected is illustrated in greater detail. As shown, the base member 31 has sinks 51, 53 and 55 in its outer face 41 and apertures 57, 59 and 61 extend from the inner face 63 through the sinks 51, 53 and 55. As can best be seen in reference to FIGS. 8 and 9, the apertures 57, 59 and 61 are arranged in rows to be aligned with the rows 17 of pads 15 on the circuit board 10 when the connector 30 is properly mounted on the circuit board 10. The apertures 57, 59 and 61 are connected in their rows by the sinks 51, 53 and 55, respectively, which are also coordinated to the rows 17 in the circuit board 10. Preferably, the interior walls of the sinks 51, 53 and 55 have ribs 65 which protrude slightly into their respective sinks.

Figure 10:
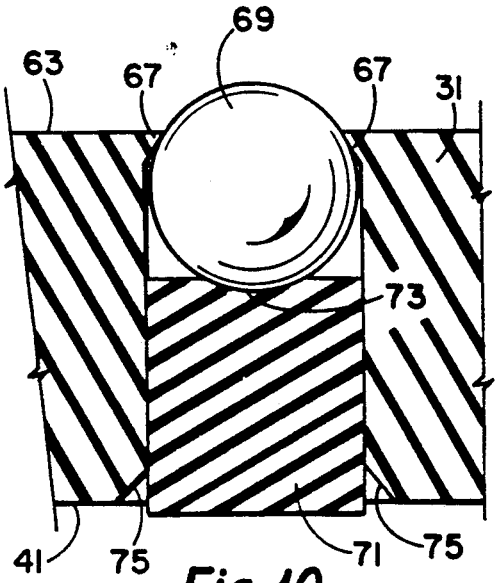
FIG. 10 is a partial enlarged view of the hole pattern illustrated in FIGS. 6, 8 and 9 illustrating a preferred embodiment of the ball bearing contacts of the card connector of FIG. 2.

As can best be seen in FIG. 10, each of the apertures is provided with a shoulder 67 in the form of an annular protrusion or lip along the inner surface 63 of the base member 31. A ball bearing 69 dropped into each of the apertures is retained in its aperture by the shoulder 67. The ball bearings 69 of each row of apertures are held in position against their shoulders 67 by a strip of elastomer 71 snugly inserted in the sink connecting the row of ball bearings 69 in a fit enhanced by the gripping action of the protruding ribs 65. Preferably, as shown in FIG. 10, the depth of the strips 71 is greater than the depth from the outer face 41 of the base member to the nearest surface 73 of the ball bearing 69 when the ball bearing is seated against the shoulder 67. Thus, when the outer surface 41 of the base member 31 is laminarly juxtaposed against the surface of the circuit board 10, the strip 71 will be compressed between the ball bearing 69 and the circuit board 10. As shown, the sinks will have a beveled edge 75 along the outer surface 41 of the base member 31 into which the strips 71 can partially expand when the strips 71 are compressed between the ball bearings 69 and the surface of the circuit board 10.

The ball bearings 69 are made of a conductive material and the elastomer strips 71 which bias the ball bearings 69 against the shoulders 67 are formed of alternating layers of conductive and dielectric material to provide discrete conductive planes extending from the ball bearings 69 to the outer surface 41 of the base member 31. One such elastomer presently available in the marketplace is the Fujipoly, Inc., Series 5002. The layers are transverse to the sinks 51, 53 and 55 or, in other words, transverse to the rows 17 of pads 15 on the circuit board 10 and also transverse to the rows of contact pads on the face of the card (not shown). Thus, aligned board contact pads 15, elastomer strips 71, ball bearings 69 and card contacts (not shown) form discrete electrically conductive paths to complete the connection of the circuits of the circuit board 10 to the circuits of the card (not shown).

Figure 7:
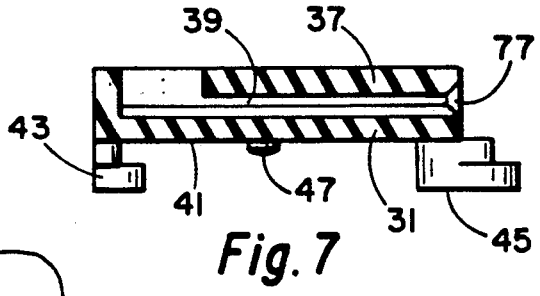
FIG. 7 is a cross-sectional view taken along the line 7—7 of FIG. 2.

Turning now to FIG. 7, which illustrates the passage 39 along a plane remote from the electrical circuit portion of the connector 30, the mouth 77 to the passage 39 is beveled to provide for smooth insertion of the card into the passage 39 without damage to the card. Furthermore, the passage 39 is deeper than is necessary to accommodate the card to further minimize the possibility of card damage. However, in order to assure a firm contact between the contact pads of the card (not shown) and the ball bearings 69, as can best be seen in FIGS. 2 and 6, the cover member 37 is provided with a land 79 which narrows the passage 39 so as to assure suitable compression between the ball bearings 69 and the card by applying pressure to the card only in the area of the card contacts. This feature is of special practical benefit since not all cards are of the same thickness. If the connector 30 is made without the land 79, then the dimensions of the connector must be changed for each significantly different card thickness. However, in this preferred embodiment of the connector 30, a varying thickness of card can be accommodated by changing only the thickness of the land 79.

If it is necessary to accommodate a card of substantially greater thickness and rigidity, the height of the connector can be changed and the width and thickness of the cover member 37 may be changed to allow greater pressure to be applied for electrically efficient contact of the ball bearings to the card contacts.

Preferably, with the exception of the ball bearings 69 and the elastomer strips 71, the entire connector 30 is an integral structure, molded of polycarbonate or ABS plastic, though any nonconductive material may be used in a given application.

In operation, the circuit board 10 is provided with notches 19 and/or sockets 21 which correspond to the feet 43 and 45 provided on the connector 30. In addition, the circuit board 10 is provided with dimples or holes 23 complementary to the bosses 47 provided on the connector 30. The connectors 30 are assembled by dropping ball bearings 69 into their appropriate apertures 57, 59 and 61 and then inserting the elastomer strips 71 into the sinks 51, 53 and 55 to secure the ball bearings 69 in their respective apertures against the shoulders 67 of the apertures at the inner face 63 of the base member 31. Preferably, the elastomer strips are gripped in place by the ribs 65 on the sinks 51, 53 and 55 with the elastomer extending outwardly of the outer face 41 of the base member 31. With the connector 30 thus assembled, the feet 43 and 45 are inserted into the appropriate notches 15 and/or sockets 21 on the circuit board 10 until the outer face 41 of the base member 31 is in laminar juxtaposition against the face of the circuit board 10. The connector 30 is then slid to hook the feet 43 and 45 against the opposite surface of the circuit board 10 until the bosses 47 on the connector 30 engage in the dimples or holes 23 in the circuit board 10 to rigidly couple the connector 30 to the circuit board 10. Thus, the connector 30 is coupled to the circuit board 10 without the use of any soldered connections whatsoever. Consequently, the connector 30 may also be disconnected from the circuit board 10 at any time by simply unsnapping the feet 43 and 45 and the dimples 47 from the circuit board 10.

When the connector 30 is mounted on the circuit board 10, the elastomer strips 71 are compressed between the ball bearings 69 and the surface of the circuit board 10 to firmly seat the ball bearings 69 against the shoulders 67 of their respective apertures. The elastomer strips 71 further expand into the spaced provided by the bevels 75 along the outer edges of the sinks 51, 53 and 55. Thus discrete electrical connection is assured between each ball bearing 69, the conductive layers of elastomer 71 in contact with the ball bearing 69 and the pads 15 of the circuit board 10 with which those conductive layers of elastomer 71 are in contact.

With the connector 30 in its rigidly mounted condition on the circuit board 10, a card inserted into the beveled mouth 77 of the connector 30 is guided and aligned within the connector 30 by the side walls 33 and 35, the cover member 37 and the base member 31 and, if used, the land 79, in firm slidable engagement with the ball bearings 69 which protrude into the passage 39 under the bias of the elastomer strips 71. The round surfaces of the ball bearings 69 provide an angled card contacting surface which guides the card into appropriate position in the passage 39 without damage to the card. As the card passes over the ball bearings 69, the ball bearings 69 are pressed into their elastomer strips 71, further compressing the strips 71 between the ball bearings 69 and the surface of the circuit board 10. Additionally, as the card passes over the ball bearings 69, the ball bearings 69 will roll or slide against the surface of the card and the surface of the elastomer strip 71 providing a cleaning action on the surfaces of the electrical contacts. This rolling or sliding action is repeated as the card is withdrawn from the passage 39, thus further assuring clean contacts for the next operation. Whenever the card is removed, as the card clears each ball bearing 69, the elastomer 71 returns to its original state, biasing each ball bearing 69 into its seated position against the shoulder 67 of the aperture, thereby sealing the aperture against intrusion by dust, dirt or other foreign substances that might inhibit electrical conductivity between the electrical components.

Thus, it is apparent that there has been provided, in accordance with the invention, an electrical circuit card connector that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A connector for interfacing a first circuit resident on a printed circuit board and having rows of externally accessible contact pads on a face of the board with a second circuit resident on a portable card and having rows of externally accessible contact pads on a face of the card, the connector comprising:

a flat base portion having rows of apertures therethrough spaced for alignment with the pads of the board;

a plurality of conductive ball bearings, one disposed in each of said apertures;

shoulder means annularly disposed along one edge of each of said apertures for retaining said ball bearings therein;

resilient means extending from another edge of each of said apertures to said ball bearings for independently biasing said ball bearings against said retaining means and having a conductive portion for providing a discrete conductive path between aligned board pads and said ball bearings when said base portion is laminarly juxtaposed on the face of the board;

mounting means fixed to said base portion for rigidly connecting said base portion to the board with said resilient means in conductive contact with aligned pads on the board; and guide means fixed to said base portion for aligning and holding the card in laminar juxtaposition against said ball bearings whereby discrete conductive paths are defined by aligned card pads, ball bearings, resilient means and board pads.

2. A connector for interfacing a first circuit resident on a printed circuit board and having rows of externally accessible contact pads on a face of the board with a second circuit resident on a portable card and having rows of externally accessible contact pads on a face of the card, the connector comprising:

a flat base portion having first and second faces and rows of apertures therethrough spaced for alignment with the pads of the board when said first face is laminarly juxtaposed on the face of the board, each of said apertures having an annular shoulder at said second face, and a plurality of sinks in said first face connecting said apertures in rows;

a plurality of conductive ball bearings, one retained in each of said apertures by said shoulders;

a plurality of strips of elastomer having conductive and dielectric layers, one snugly seated in each said sink with said layers transverse to said rows, said strips biasing said ball bearings against said shoulders when said first face is laminarly juxtaposed on the face of the board;

first means fixed to said base portion for rigidly connecting said base portion to the board with said strips in abutment with the rows of pads on the board; and second means fixed to said base portion for receiving, aligning and holding the card in laminar juxtaposition against said second face with said ball bearings in contact with the pads of the card whereby discrete conductive paths are defined by aligned card pads, ball bearings, elastomer layers and board pads.

3. The connector according to claim 2, said annular shoulders comprising a lip integral to said base portion and inwardly tapered to said second face.

4. The connector according to claim 2 further comprising a plurality of ribs integrally inwardly projecting into each of said sinks for gripping said strips of elastomer therebetween.

5. The connector according to claim 2, said strips having a depth greater than the depth from said first face to said ball bearings seated against said shoulders whereby said strips are compressed between said ball bearings and the board when said first face is in abutment with the board.

6. The connector according to claim 5, said sinks having bevelled edges along said first face into which said strips partially expand when said strips are compressed between said ball bearings and the board.

7. The connector according to claim 2, said second means having a bevelled mouth for slidably receiving the card therein.

8. The connector according to claim 2, said second means having a portion protruding toward said ball bearings for holding the card in firm slidable engagement with said ball bearings.

9. The connector according to claim 2, the board having sockets therethrough and said first means comprising feet depending from said first face and insertable into and slidable with said connector in relation to said sockets.

10. The connector according to claim 9, the board having dimples therein and said first face further comprising complimentary bosses thereon engaging with said dimples when the pads on the board are aligned with said ball bearings.

11. A connector for interfacing a first circuit resident on a printed circuit board and having rows of externally accessible contact pads on a face of the board with a second circuit resident on a portable card and having rows of externally accessible contact pads on a face of the card, the connector comprising:

a base member having rows of apertures therethrough spaced for alignment with the pads of the board, each of said apertures having an annular shoulder at one end thereof, and a plurality of sinks connecting said apertures in rows;

a plurality of conductive bali bearings, one retained in each of said apertures by said shoulders;

a plurality of strips of elastomer having conductive and dielectric layers, one snugly seated in each said sink with said layers transverse to said rows;

first means fixed to said member for rigidly connecting said member to the board with said strips in abutment with the rows of pads on the board; and second means fixed to said base for receiving the card in laminar juxtaposition against said second face with said ball bearings in contact with the pads of the card whereby discrete conductive paths are defined by aligned card pads, ball bearings, elastomer layers and board pads.

12. A connector for interfacing a first circuit resident on a printed circuit board and having rows of externally accessible contact pads on a face of the board with a second circuit resident on a portable card and having rows of externally accessible contact pads on a face of the card, the connector comprising:

a housing having a flat base, a flat cover and a flat, narrow, externally accessible passage therebetween for laminar insertion of the card therein, said base having first and second faces and rows of apertures therethrough spaced for alignment with the pads of the board when said first face is laminarly juxtaposed on the face of the board, each of said apertures having an annular shoulder at said second face, and a plurality of sinks in said first face connecting said apertures in rows;

a plurality of conductive ball bearings, one retained in each of said apertures by said shoulders;

a plurality of strips of elastomer having conductive and dielectric layers, one snugly seated in each said sink with said layers transverse to said rows, said strips biasing said ball bearings against said shoulders when said first face is laminarly juxtaposed on the face of the board;

means fixed to said base for rigidly connecting said base to the board with said strips in abutment with the rows of pads on the board; and side walls connecting said base and said top for aligning the card with said ball bearings in contact with the pads of the card whereby discrete conductive paths are defined by aligned card pads, ball bearings, elastomer layers and board pads.

13. A connector for interfacing a first circuit resident on a printed circuit board and having rows of externally accessible contact pads on a face of the board with a second circuit resident on a portable card and having rows of externally accessible contact pads on a face of the card, the connector comprising:

a housing having a flat base and a flat cover spaced by side walls to define a flat, externally accessible passage for receiving, guiding and holding the card in laminar position between said base and said cover, said base having inner and outer faces and rows of apertures therethrough spaced for alignment with the pads of the board when said outer face is laminarly juxtaposed on the face of the board, each of said apertures having a tapered shoulder along an outer end thereof, and a plurality of sinks in said outer face connecting said apertures in rows;

a plurality of conductive ball bearings, one retained in each of said apertures by said shoulders;

a plurality of strips of elastomer having conductive and dielectric layers, one snugly seated in each said sink with said layers transverse to said rows, said strips biasing said ball bearings against said shoulders when said outer face is laminarly juxtaposed on the face of the board; and means fixed to said base for rigidly connecting said base to the board with said strips in abutment with the rows of pads on the board whereby, when the card is inserted into said passage, discrete conductive paths are defined by aligned card pads, ball bearings, elastomer layers and board pads.

14. The connector according to claim 13 further comprising a plurality of ribs integrally inwardly projecting into each of said sinks for gripping said strips of elastomer therebetween.

15. The connector according to claim 14, said sinks having a depth greater than the depth from said outer face to said ball bearings seated against said shoulders whereby said strips are compressed between said ball bearings and the board when said outer face is in abutment with the board.

16. The connector according to claim 13, said apertures having bevelled edges along said outer face into which said strips partially expand when said strips are compressed between said ball bearings and the board.

17. The connector according to claim 13, said passage having a bevelled mouth for slidably receiving the card therein.

18. The connector according to claim 13, said cover having a land protruding from said inner face thereof toward said ball bearings for holding the card in firm slidable engagement with said ball bearings.

19. The connector according to claim 13, the board having sockets therethrough and said means comprising feet depending from said outer face and insertable into and slidable with said connector in relation to said sockets.

20. The connector according to claim 19, the board having dimples therein and said outer face further comprising complimentary bosses thereon engaging with said dimples when the pads on the board are aligned with said ball bearings.

* * * * *